US007872407B2

(12) United States Patent
Fu et al.

(10) Patent No.: US 7,872,407 B2
(45) Date of Patent: Jan. 18, 2011

(54) FIELD EMISSION CATHODE HAVING SUCCESSIVE AND ORIENTED CARBON NANOTUBE BUNDLES

(75) Inventors: Wei-Qi Fu, Beijing (CN); Peng Liu, Beijing (CN); Chen Feng, Beijing (CN); Xiao-Bo Zhang, Beijing (CN); Kai-Li Jiang, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 408 days.

(21) Appl. No.: 12/002,144

(22) Filed: Dec. 14, 2007

(65) Prior Publication Data

US 2008/0258599 A1 Oct. 23, 2008

(30) Foreign Application Priority Data

Apr. 20, 2007 (CN) ..... 2007 1 0074133

(51) Int. Cl.
*H01J 9/02* (2006.01)

(52) U.S. Cl. ..... 313/310; 313/311

(58) Field of Classification Search ..... 313/495, 313/496, 497, 293, 310, 311, 336, 422, 309; 445/51; 423/455 R See application file for complete search history.

(56) References Cited

U.S. PATENT DOCUMENTS 6,159,892 A * 12/2000 Moy et al. ..... 502/174
7,054,064 B2 5/2006 Jiang et al.
7,586,249 B2 9/2009 Jiang et al.
7,794,793 B2 * 9/2010 Liang ..... 427/331
2003/0090190 A1 * 5/2003 Takai et al. ..... 313/311
2004/0047038 A1 * 3/2004 Jiang et al. ..... 359/486
2004/0071949 A1 4/2004 Glatkowski et al.

(Continued)

FOREIGN PATENT DOCUMENTS

TW 200410901 7/2004

(Continued)

OTHER PUBLICATIONS

Spinning and processing continuous yarns from 4-inch wafer scale super-aligned carbon nanotube arrays,Adv. Mater. 2006, 18, 1505-1510,2006, Wiley-VCH Verlag GmbH & Co. KGaA, Weinheim.

*Primary Examiner*—Nimeshkumar D Patel
*Assistant Examiner*—Glenn Zimmerman
(74) *Attorney, Agent, or Firm*—Jeffrey T. Knapp

(57) ABSTRACT

A field emission cathode includes a conductive substrate and a carbon nanotube film disposed on a surface of the conductive substrate. The carbon nanotube film includes a plurality of successive and oriented carbon nanotube bundles parallel to the conductive substrate, the carbon nanotubes partially extrude from the carbon nanotube film. A method for fabricating the field emission cathode includes the steps of: (a) providing a conductive substrate; (b) providing at least one carbon nanotube film, the carbon nanotube film including a plurality of successive and oriented carbon nanotube bundles joined end to end, the carbon nanotube bundles parallel to the conductive substrate, and (c) disposing the at least one carbon nanotube film to the conductive substrate to achieve the field emission cathode.

12 Claims, 5 Drawing Sheets

U.S. PATENT DOCUMENTS

| | | | | |
|---|---|---|---|---|
| 2004/0105807 | A1 | 6/2004 | Fan et al. | |
| 2006/0018018 | A1 | 1/2006 | Nomura et al. | |
| 2006/0121185 | A1 | 6/2006 | Xu et al. | |
| 2007/0075619 | A1* | 4/2007 | Jiang et al. | 313/336 |
| 2007/0103052 | A1 | 5/2007 | Jeng et al. | |
| 2008/0111463 | A1* | 5/2008 | Kuo | 313/495 |
| 2008/0198453 | A1 | 8/2008 | LaFontaine et al. | |
| 2010/0193350 | A1* | 8/2010 | Liu et al. | 204/192.15 |

FOREIGN PATENT DOCUMENTS

| | | |
|---|---|---|
| TW | I245303 | 12/2005 |
| TW | I248630 | 2/2006 |
| TW | I257639 | 7/2006 |
| TW | I277124 | 3/2007 |
| TW | 200713384 | 4/2007 |

* cited by examiner

FIELD EMISSION CATHODE HAVING SUCCESSIVE AND ORIENTED CARBON NANOTUBE BUNDLES

RELATED APPLICATIONS

This application is related to commonly-assigned applications entitled, "CARBON NANOTUBE FILM STRUCTURE AND METHOD FOR FABRICATING THE SAME", Ser. No. 12/002,129 filed Dec. 14, 2007, "OPTICAL POLARIZER AND METHOD FOR FABRICATING THE SAME", Ser. No. 12/002,169 filed Dec. 14, 2007, and "ANODE OF LITHIUM BATTERY AND METHOD FOR FABRICATING THE SAME", Ser. No. 12/002,143 filed Dec. 14, 2007. Disclosures of the above-identified applications are incorporated herein by reference.

BACKGROUND

1. Field of the Invention

The present invention relates to field emission cathodes and methods for fabricating the same and, particularly, to a carbon nanotube film based field emission cathode and a method for fabricating the same.

2. Discussion of Related Art

Carbon nanotubes (CNT) are a novel carbonaceous material and received a great deal of interest since the early 1990s. Typically, carbon nanotubes have tube-shaped structures with small diameters (less than 100 nanometers) and large aspect ratios (length/diameter). The carbon nanotubes have excellent electrical properties as well as excellent mechanical properties. The electronic conductance of the carbon nanotubes is related to their structures. Carbon nanotubes can transmit extremely high current density and emit electrons easily, at low voltages, less than 100 volts. Thus they are considered to be promising for use in a variety of display devices, such as field emission display (FED) devices.

Generally, a CNT field emission display device includes a cathode electrode and a carbon nanotube array formed on the cathode electrode. The methods adopted for forming the carbon nanotube array on the cathode electrode mainly include in-situ synthesis methods and printing methods.

An in-situ synthesis method is performed by coating metal catalysts on a conductive cathode electrode and directly growing carbon nanotubes on the conductive cathode electrode by means of chemical vapor deposition (CVD). However, the carbon nanotubes synthesized on the cathode electrode inevitably entangle with each other. Thus, the field emission characteristics of the carbon nanotube array are generally unsatisfactory.

A printing method is performed by printing a pattern on a conductive cathode electrode using carbon nanotube based conductive paste or organic binder. The carbon nanotubes can extrude from the pattern to form emitters by a series of treating processes. However, the density of the effective carbon nanotube emitters is relatively low, and the carbon nanotubes entangle with each other and are oblique to the conductive cathode electrode. Furthermore, the treating processes may include a step of peeling the paste off to form extrusions of the carbon nanotubes. Such peeling step may damage the carbon nanotubes and/or decrease their performance. Thus, the efficiency of electron emission is relatively low, and controllability is often less than desired. Still furthermore, the printing method has relatively high cost.

What is needed, therefore, is to provide a field emission cathode and a method for fabricating the same, in which the field emission cathode has a stable field emission performance and a high efficiency, and the method can be utilized easily and at a low cost.

SUMMARY

In one embodiment, a field emission cathode includes a conductive substrate having a surface and a carbon nanotube film disposed on the surface of the conductive substrate. The carbon nanotube film includes a plurality of successive and oriented carbon nanotube bundles parallel to the conductive substrate, and carbon nanotubes of the carbon nanotube bundles partially extrude from the carbon nanotube film.

Other advantages and novel features of the present field emission cathode and a related method for fabricating the same will become more apparent from the following detailed description of preferred embodiments when taken in conjunction with the accompanying drawings.

BRIEF DESCRIPTION OF THE DRAWINGS

Many aspects of the present field emission cathode and the related method for fabricating the same can be better understood with reference to the following drawings. The components in the drawings are not necessarily to scale, the emphasis instead being placed upon clearly illustrating the principles of the present field emission cathode and the related method for fabricating the same.

Figure 1:
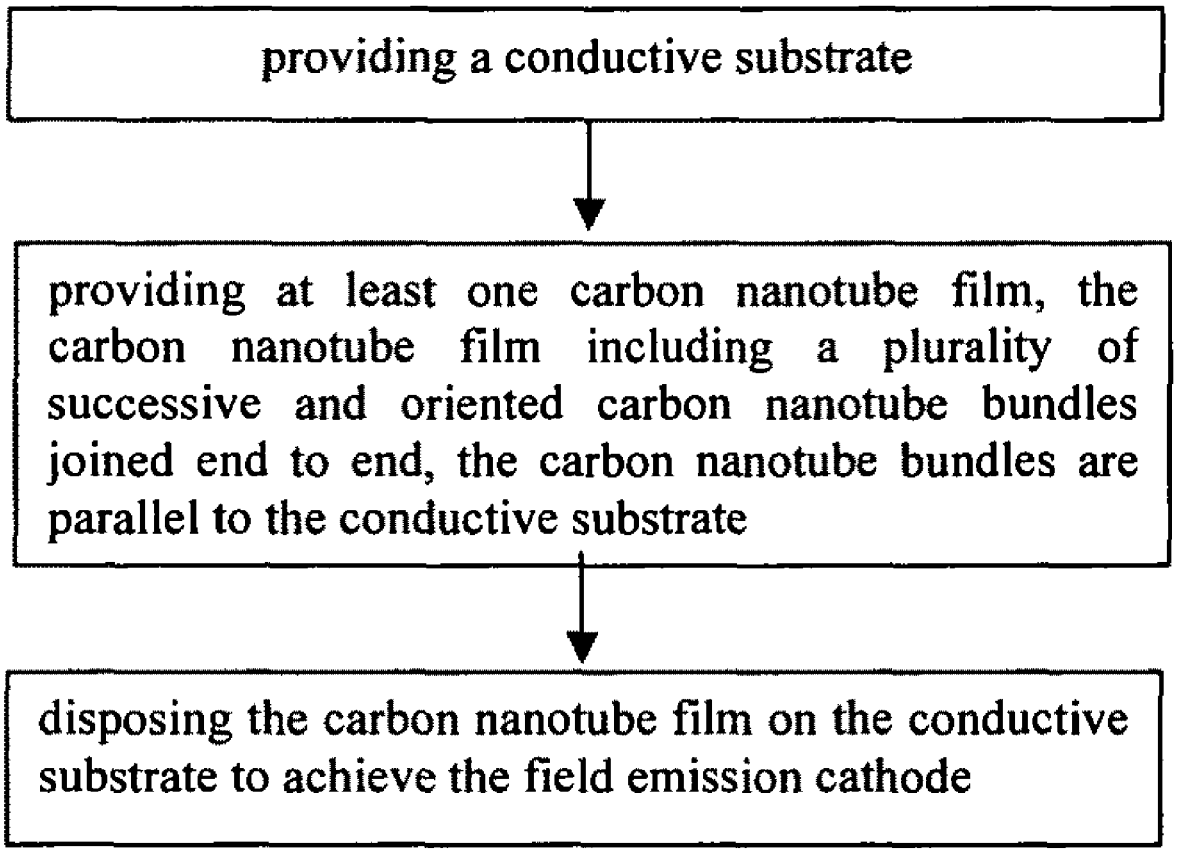
FIG. 1 is a flow chart of a method for fabricating a field emission cathode in accordance with a present embodiment.

Corresponding reference characters indicate corresponding parts throughout the several views. The exemplifications set out herein illustrate at least one preferred embodiment of the present field emission cathode and the related method for fabricating the same, in at least one form, and such exemplifications are not to be construed as limiting the scope of the invention in any manner.

DETAILED DESCRIPTION OF PREFERRED EMBODIMENTS

Reference will now be made to the drawings to describe, in detail, embodiments of the present field emission cathode and the related method for fabricating the same.

Referring to FIG. 1, a method for fabricating a field emission cathode includes the steps of: (a) providing a conductive substrate; (b) providing at least one carbon nanotube film, the carbon nanotube film including a plurality of successive and oriented carbon nanotube bundles joined end to end, the carbon nanotube bundles are parallel to the conductive substrate, and (c) disposing the at least one carbon nanotube film on the conductive substrate to achieve the field emission cathode.

In step (a), the conductive substrate can, beneficially, be indium tin oxide (ITO) glass or any other conductive materials used as the substrate of field emission cathodes.

In step (b), the carbon nanotube film can be formed by the substeps of: (b1) providing an array of carbon nanotubes, quite suitably, providing a super-aligned array of carbon nanotubes; (b2) selecting a plurality of carbon nanotube segments having a predetermined width from the array of carbon nanotubes; (b3) pulling the carbon nanotube segments at an even speed to form a carbon nanotube film.

In step (b1), the super-aligned array of carbon nanotubes can be formed by the steps of: (b11) providing a substantially flat and smooth substrate; (b12) forming a catalyst layer on the substrate; (b13) annealing the substrate with the catalyst layer in air at a temperature in the approximate range from 700° C. to 900° C. for about 30 to 90 minutes; (b14) heating the substrate with the catalyst layer at a temperature in the approximate range from 500° C. to 740° C. in a furnace in protective gas; (b15) supplying a carbon source gas to the furnace for about 5 to 30 minutes and growing a super-aligned array of carbon nanotubes from the substrate.

In step (b11), the substrate can be a P-type silicon wafer, an N-type silicon wafer, or a silicon wafer with a film of silicon oxide thereon. Preferably, a 4 inch P-type silicon wafer is used as the substrate.

In step (b12), the catalyst can, advantageously, be made of iron (Fe), cobalt (Co), nickel (Ni), or any alloy thereof.

In step (b14), the protective gas can, beneficially, be nitrogen ($N_2$), ammonia ($NH_3$) or a noble gas. In step (b15), the carbon source gas can be a hydrocarbon gas such as ethylene ($C_2H_4$), methane ($CH_4$), acetylene ($C_2H_2$), ethane ($C_2H_6$) or any combination thereof.

The super-aligned array of carbon nanotubes can, opportunely, have a height of about 200 to 400 microns and includes a plurality of carbon nanotubes parallel to each other and approximately perpendicular to the substrate. The super-aligned array of carbon formed under the above conditions is essentially free of impurities such as carbonaceous or residual catalyst particles. The carbon nanotubes in the super-aligned array are packed together closely by the van der Waals attractive force.

In step (b2), quite usefully, the carbon nanotube segments having a predetermined width can be selected by using an adhesive tape to contact with the super-aligned array. In step (b3), the pulling direction is substantially perpendicular to the growing direction of the super-aligned array of carbon nanotubes.

Figure 2:
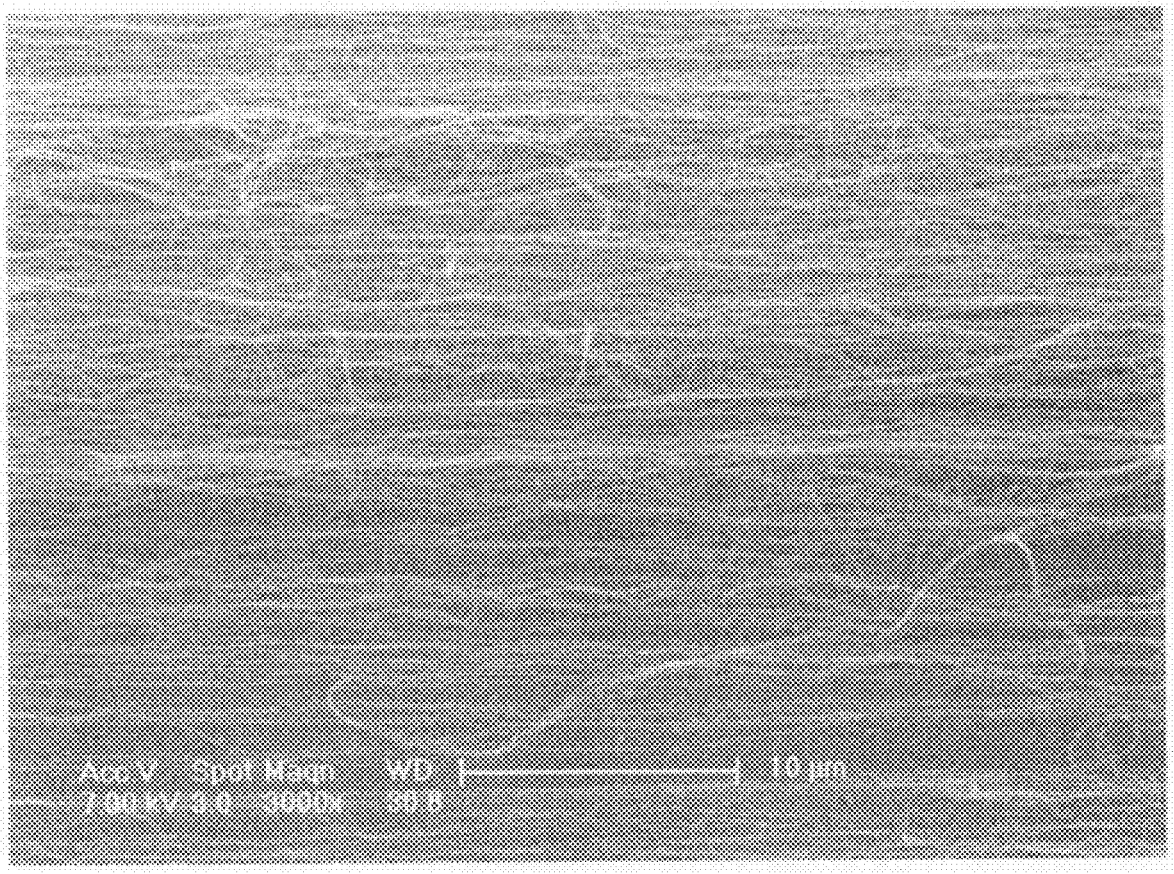
FIG. 2 shows a Scanning Electron Microscope (SEM) image of a carbon nanotube film of the field emission cathode of FIG. 1.

More specifically, during the pulling process, as the initial carbon nanotube segments are drawn out, other carbon nanotube segments are also drawn out end to end due to the van der Waals attractive force between ends of adjacent segments. This process of drawing ensures a successive carbon nanotube film having a predetermined width can be formed. The carbon nanotube film includes a plurality of carbon nanotube segments. The carbon nanotubes in the carbon nanotube film are substantially parallel to the pulling direction of the carbon nanotube film. Furthermore, as shown in FIG. 2, the carbon nanotubes can partially extrude from the surface of the carbon nanotube film.

The width of the carbon nanotube film depends on the size of the carbon nanotube array. The length of the carbon nanotube film can be arbitrarily set as desired. In one useful embodiment, when the substrate is a 4 inch type wafer as in the present embodiment, the width of the carbon nanotube film is in the range of 1 centimeter to 10 centimeters and the thickness of the carbon nanotube film is in the range of 0.01 to 100 microns.

It is noted that because the carbon nanotubes in the super-aligned array in step (a) has a high purity and a high specific surface area, the carbon nanotube film is adhesive. As such, in step (c), the first carbon nanotube film can be adhered to a surface of the conductive substrate directly.

In one useful embodiment, an additional step (d) of forming a comb-shaped silver paste film 16 (shown in FIG. 3) on the conductive substrate can be further provided before the step (c).

After the step (d), the carbon nanotube film can be adhered to a surface of the comb-shaped silver paste film on the conductive substrate. The comb-shaped silver paste film can combine the carbon nanotube film with the conductive substrate tightly to prevent the desquamation of the carbon nanotube film under the high electrical field. The shape of the silver paste film is arbitrarily.

Quite usefully, the carbon nanotube film can be treated with an organic solvent. The organic solvent is volatilizable and can be selected from the group consisting of ethanol, methanol, acetone, dichloroethane, chloroform and combinations thereof. Quite suitably, in this embodiment the organic solvent is ethanol. After soaking in the organic solvent, the carbon nanotube segments in the carbon nanotube film can at least partially shrink into carbon nanotube bundles due to the surface tension of the organic solvent. Due to the decrease of the surface area, the carbon nanotube film loses viscosity but maintained high mechanical strength and toughness.

It is to be understood that, a plurality of carbon nanotube films can, advantageously, be adhered to the conductive substrate and overlapped with each other to form a multi-layer carbon nanotube film. The number of the layers and the angle between the aligned directions of two adjacent layers may be arbitrarily set as desired. The layers of the carbon nanotube film are combined by van de Waals attractive force to form a stable multi-layer film.

Figure 3:
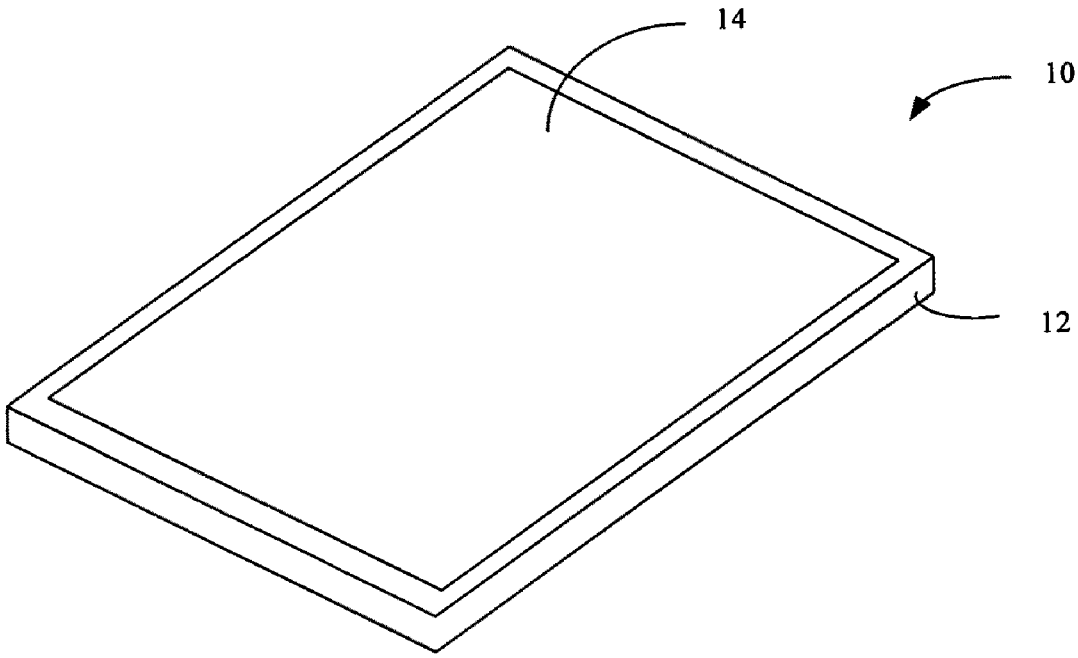
FIG. 3 is a schematic view of the field emission cathode fabricated by the method of FIG. 1.

Referring to FIG. 3, a field emission cathode 10 manufactured by the above-described method includes a conductive substrate 12 and a carbon nanotube film 14 supported by the conductive substrate 12. The conductive substrate 12 can, beneficially, be made of indium tin oxide (ITO) glass or any other conductive materials used as the substrate of field emission cathodes. The carbon nanotube film 14 can, advantageously, be disposed on a surface of the conductive substrate 12 directly, and includes a plurality of successive and oriented carbon nanotube bundles joined end to end. The carbon nanotube bundles are parallel to the conductive substrate 12. The carbon nanotubes 18 partially extrude from the carbon nanotube film 14 and are substantially perpendicular to the conductive substrate 12. The thickness of the carbon nanotube film 14 is in the range of about 0.01 to 100 microns. Additionally, the carbon nanotube film 14 can, beneficially, include of a plurality of overlapped carbon nanotube films 14.

Figure 4:
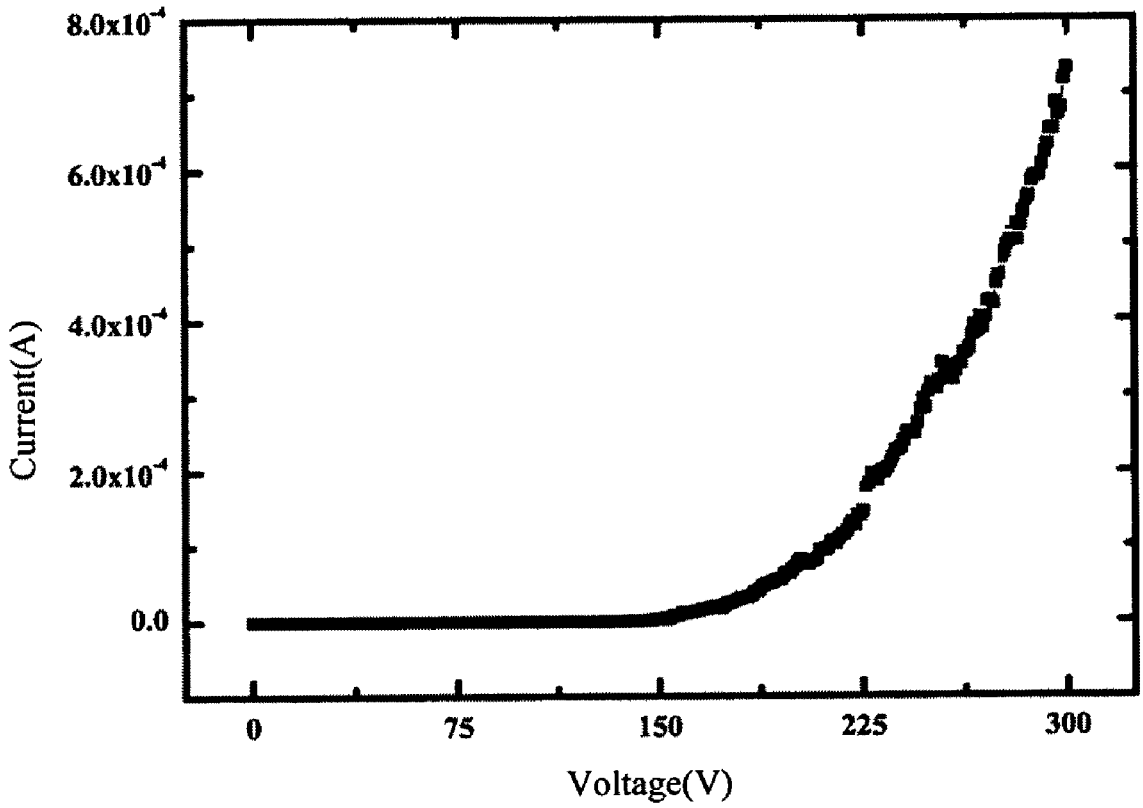
FIG. 4 is a current-voltage curve of the field emission cathode fabricated by the method of FIG. 1.
Figure 5:
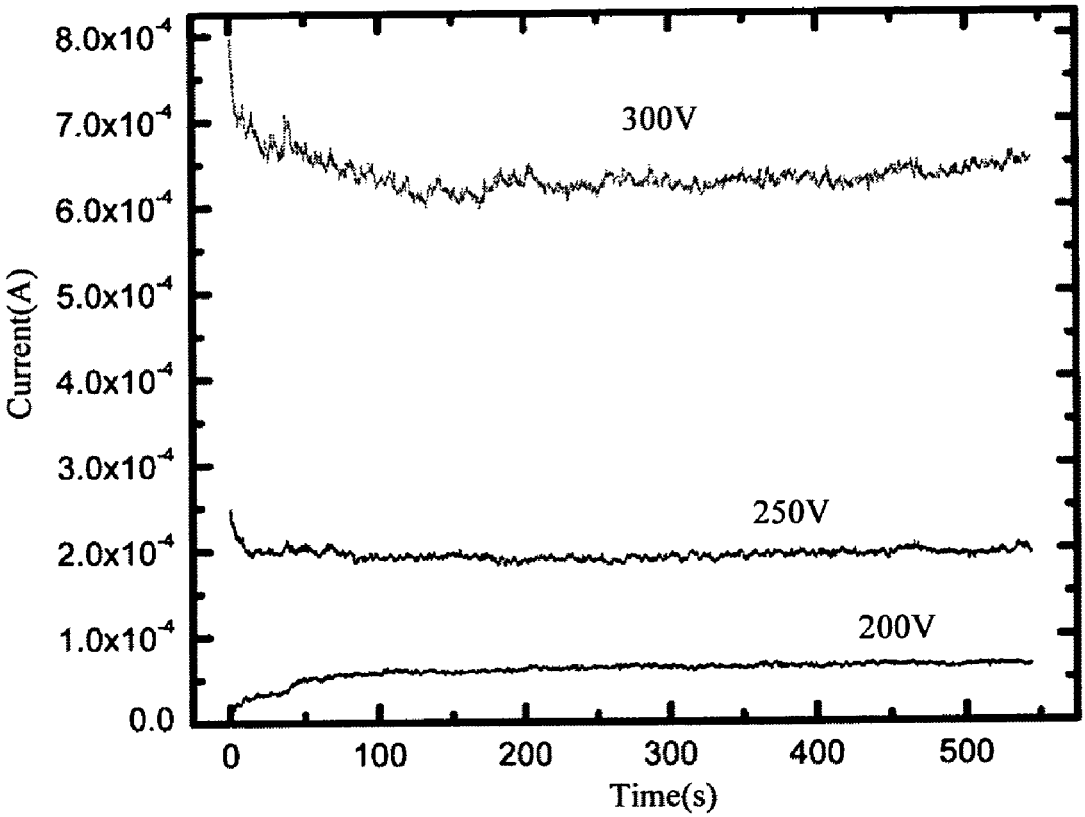
FIG. 5 shows field emission currents under different voltages of the field emission cathode fabricated by the method of FIG. 1.

Referring to FIG. 4, during application of the field emission cathode fabricated by the method as described above, the field emission cathode is grounded, and a positive voltage is applied to an anode substrate. The extrusions of the carbon nanotubes act as field emitters. As such, the field emission cathode performs well. As shown in FIG. 4, when the voltage is above 150V, the current of the anode increases significantly. Referring to FIG. 5, the field emission cathode has a relatively high stability at different voltages.

In the present embodiment, the carbon nanotube film can be pulled out from the array of carbon nanotubes directly. It is noted that, because the carbon nanotubes in the super-aligned array have a high purity and a high specific surface area, the carbon nanotube film is adhesive. Therefore, the carbon nanotube film can be simply adhered to a surface of the conductive substrate to form the field emission cathode. Though the carbon nanotube film includes a plurality of successive carbon nanotube bundles joined end-to-end parallel to the conductive substrate, the extrusion of the carbon nanotubes is advantageous for electron emission.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

The invention claimed is:

1. A field emission cathode comprising:

a conductive substrate comprising a surface; and a carbon nanotube film disposed on the surface of the conductive substrate, wherein the carbon nanotube film comprises a plurality of successive and oriented carbon nanotube bundles parallel to the surface of the conductive substrate, and carbon nanotubes partially extruding from the carbon nanotube film.

2. The field emission cathode of claim 1, wherein a thickness of the carbon nanotube film is in the approximate range of 0.01 to 100 microns.

3. The field emission cathode of claim 1, wherein a material of the conductive substrate is indium tin oxide glass.

4. The field emission cathode of claim 1, wherein a silver paste film is further disposed between the conductive substrate and the carbon nanotube film.

5. The field emission cathode of claim 4, wherein the silver paste film has a comb shape.

6. The field emission cathode of claim 1 further comprising a plurality of overlapped carbon nanotube films disposed on the surface of the conductive substrate.

7. The field emission cathode of claim 6, wherein the carbon nanotube films are combined by van der Waals attractive force to form a stable multi-layer film.

8. The field emission cathode of claim 1, wherein the plurality of successive and oriented carbon nanotube bundles are joined end to end.

9. A field emission cathode comprising:

a conductive substrate comprising a surface; and a plurality of overlapped carbon nanotube films disposed on the surface of the conductive substrate, wherein each of the plurality of carbon nanotube films comprises a plurality of successive and oriented carbon nanotube bundles parallel to the conductive substrate, and carbon nanotubes partially extruding from the plurality of carbon nanotube films, the plurality of carbon nanotube films are combined by van der Waals attractive force to form a multi-layer film.

10. The field emission cathode of claim 9, wherein the plurality of successive and oriented carbon nanotube bundles are joined end to end.

11. A field emission cathode comprising:

a conductive substrate comprising a surface; and a carbon nanotube film disposed on the surface of the conductive substrate, wherein the carbon nanotube film comprises a plurality of successive and oriented carbon nanotube bundles parallel to the surface of the conductive substrate and carbon nanotubes partially extruding from the carbon nanotube film, the plurality of successive and oriented carbon nanotube bundles are joined end to end.

12. The field emission cathode of claim 11, wherein the carbon nanotube film is adhered to the surface of the conductive substrate.

* * * * *